US008064807B2

(12) United States Patent
Koeda et al.

(10) Patent No.: US 8,064,807 B2
(45) Date of Patent: Nov. 22, 2011

(54) DEVELOPER SUPPLY SYSTEM AND IMAGE FORMING APPARATUS INCORPORATING SAME

(75) Inventors: Maiko Koeda, Numazu (JP); Koichi Kato, Yokohama (JP); Emi Kita, Tokyo (JP); Keiko Matsumoto, Yokohama (JP); Takuzi Yoneda, Tokyo (JP); Yuki Oshikawa, Yamato (JP); Kohichi Utsunomiya, Atsugi (JP)

(73) Assignee: Ricoh Company Limited, Tokyo (JP)

( * ) Notice: Subject to any disclaimer, the term of this patent is extended or adjusted under 35 U.S.C. 154(b) by 251 days.

(21) Appl. No.: 12/425,804

(22) Filed: Apr. 17, 2009

(65) Prior Publication Data

US 2009/0263164 A1 Oct. 22, 2009

(30) Foreign Application Priority Data

Apr. 17, 2008 (JP) ..... 2008-108246

(51) Int. Cl.
*G03G 15/08* (2006.01)

(52) U.S. Cl. ..... 399/262; 399/259

(58) Field of Classification Search ..... 399/258, 399/259, 262, 27, 264, 254, 238
See application file for complete search history.

(56) References Cited

U.S. PATENT DOCUMENTS

| | | | | |
|---|---|---|---|---|
| 7,482,104 | B2 | 1/2009 | Kondo et al. | |
| 7,801,467 | B2 * | 9/2010 | Uno et al. | 399/258 |
| 2003/0012586 | A1 * | 1/2003 | Iwata et al. | 399/258 |
| 2006/0002743 | A1 * | 1/2006 | Katsuyama et al. | 399/258 |
| 2008/0175628 | A1 | 7/2008 | Kita et al. | |
| 2008/0175635 | A1 | 7/2008 | Hozumi et al. | |
| 2008/0181630 | A1 | 7/2008 | Matsumoto et al. | |
| 2008/0187332 | A1 | 8/2008 | Tsuda et al. | |
| 2008/0240792 | A1 | 10/2008 | Kita et al. | |
| 2008/0253810 | A1 | 10/2008 | Tateyama et al. | |
| 2008/0254378 | A1 | 10/2008 | Matsumoto et al. | |
| 2008/0279592 | A1 | 11/2008 | Matsumoto et al. | |

(Continued)

FOREIGN PATENT DOCUMENTS

JP 2000-221866 8/2000

(Continued)

OTHER PUBLICATIONS

U.S. Appl. No. 12/253,538, filed Oct. 17, 2008, Mugijiro Uno, et al.

(Continued)

*Primary Examiner* — David Porta
*Assistant Examiner* — Faye Boosalis
(74) *Attorney, Agent, or Firm* — Oblon, Spivak, McClelland, Maier & Neustadt, L.L.P.

(57) ABSTRACT

A developer supply system includes a container, a memory, and a positioning mechanism. The container has a deformable bag formed of flexible material to accommodate developer therein. The memory is attached to a given planar surface of the deformable bag to store information for communication to the image forming apparatus. The positioning mechanism holds the container therein while maintaining the given planar surface in position relative to the image forming apparatus when the deformable bag collapses as it discharges developer. An image forming apparatus employing such a developer supply system is also disclosed.

20 Claims, 6 Drawing Sheets

U.S. PATENT DOCUMENTS

| | | | |
|---|---|---|---|
| 2008/0310865 | A1 | 12/2008 | Uno et al. |
| 2008/0317508 | A1 | 12/2008 | Terai et al. |
| 2009/0016777 | A1 | 1/2009 | Miyamoto et al. |
| 2009/0041508 | A1 | 2/2009 | Oshikawa et al. |
| 2009/0074432 | A1 | 3/2009 | Kita et al. |
| 2009/0080943 | A1 | 3/2009 | Kato et al. |
| 2009/0087214 | A1 | 4/2009 | Utsunomiya et al. |

FOREIGN PATENT DOCUMENTS

| | | |
|---|---|---|
| JP | 2006-003722 | 1/2006 |
| JP | 2006-184643 | 7/2006 |

OTHER PUBLICATIONS

U.S. Appl. No. 12/246,027, filed Oct. 6, 2008, Mugijirou Uno, et al.

* cited by examiner

DEVELOPER SUPPLY SYSTEM AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application No. 2008-108246 filed on Apr. 17, 2008, the contents of which are hereby incorporated by reference herein in their entirety.

BACKGROUND OF THE INVENTION

1. Field of the Invention

The present invention relates to a developer supply system and an image forming apparatus incorporating same, and more particularly, to a developer supply system that supplies an electrophotographic developer formed of a mixture of toner and carrier particles, and an image forming apparatus incorporating such a developer supply system.

2. Discussion of the Background

Electrophotographic image forming apparatuses, such as photocopiers, printers, facsimiles, or the like, have development devices in which an electrostatic latent image formed on a photoconductor drum or belt according to image data is rendered visible using developer particles. A common form of such development process uses a two-component developer formed of a mixture of toner and carrier particles that form a "magnetic brush" to transfer toner to a photoconductive surface. Due to its high toner transfer rate, reproducibility of halftone images, and immunity to effects of temperature and/or humidity variations, magnetic brush development has become prevalent in modern electrophotographic apparatuses.

A magnetic brush development device typically incorporates a developer supply system that continuously supplies new toner as the two-component developer becomes depleted of toner during repeated imaging cycles. The developer supply system holds new toner in a replaceable container or cartridge, such as a plastic bottle or a deformable bag formed of flexible material, which is detachably mounted on the printer to establish fluid communication with the development unit.

Currently, some toner cartridges feature automatic identification technologies to enable a printer to identify characteristic of a cartridge or toner in use. Such a cartridge has an embedded data carrier or memory, e.g., a radio frequency identification (RFID) chip, so that a host device or printer can retrieve various types of identification data, such as type of compatible printer, date of manufacture, color of toner, or remaining amount of toner, etc., by establishing electrical contact with the memory. Such identification capability allows ready management of printers employing two-component developer, and will likely be widely adopted in future products and systems related to electrophotography. In this regard, various techniques have been proposed to provide a developer container with identification capability.

For example, one conventional technique provides a "bag-in-box" toner cartridge with an identification data carrier. This cartridge is formed of a flexible bag accommodating toner and a rigid enclosure box surrounding the flexible bag, and the data carrier is attached to the enclosure box. The technique is designed for use in a host device having a data reader built in a holder for holding the enclosure box. When properly installed and positioned, the cartridge can exchange information with the host device through electrical connection established between the data carrier and reader.

Another conventional technique proposes a toner container formed of a flexible toner bag without an enclosure box, which has a data carrier attached to a fitting defining an exit port for connection to an image forming apparatus. Compared to the bag-in-box container, the toner bag without enclosure allows for easy recycling or disposal when empty. According to this method, providing the data carrier on the fitting efficiently holds it in position relative to the image forming apparatus, where the fitting is securely connected to the apparatus body to provide fluid communication between the cartridge and the image forming apparatus. However, such a technique has a drawback in that the data carrier located adjacent to the exit port is susceptible to contamination from particles leaking around the fitting, making it difficult to provide a reliable electrical connection between the data carrier and reader in the developer supply system.

SUMMARY OF THE INVENTION

Exemplary aspects of the present invention are put forward in view of the above-described circumstances, and provide a novel developer supply system that supplies electrophotographic developer in an image forming apparatus.

Other exemplary aspects of the present invention provide a novel image forming apparatus employing a developer supply system to supply electrophotographic developer.

In one exemplary embodiment, the novel developer supply system includes a container, a memory, and a positioning mechanism. The container has a deformable bag formed of flexible material to accommodate developer therein. The memory is attached to a given planar surface of the deformable bag to store information for communication to the image forming apparatus. The positioning mechanism holds the container therein while maintaining the given planar surface in position relative to the image forming apparatus when the deformable bag collapses as it discharges developer.

In one exemplary embodiment, the image forming apparatus includes a developer supply system. The developer supply system includes a container, a memory, and a positioning mechanism. The container has a deformable bag formed of flexible material to accommodate developer therein. The memory is attached to a given planar surface of the deformable bag to store information for communication to the image forming apparatus. The positioning mechanism holds the container therein while maintaining the given planar surface in position relative to the image forming apparatus when the deformable bag collapses as it discharges developer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
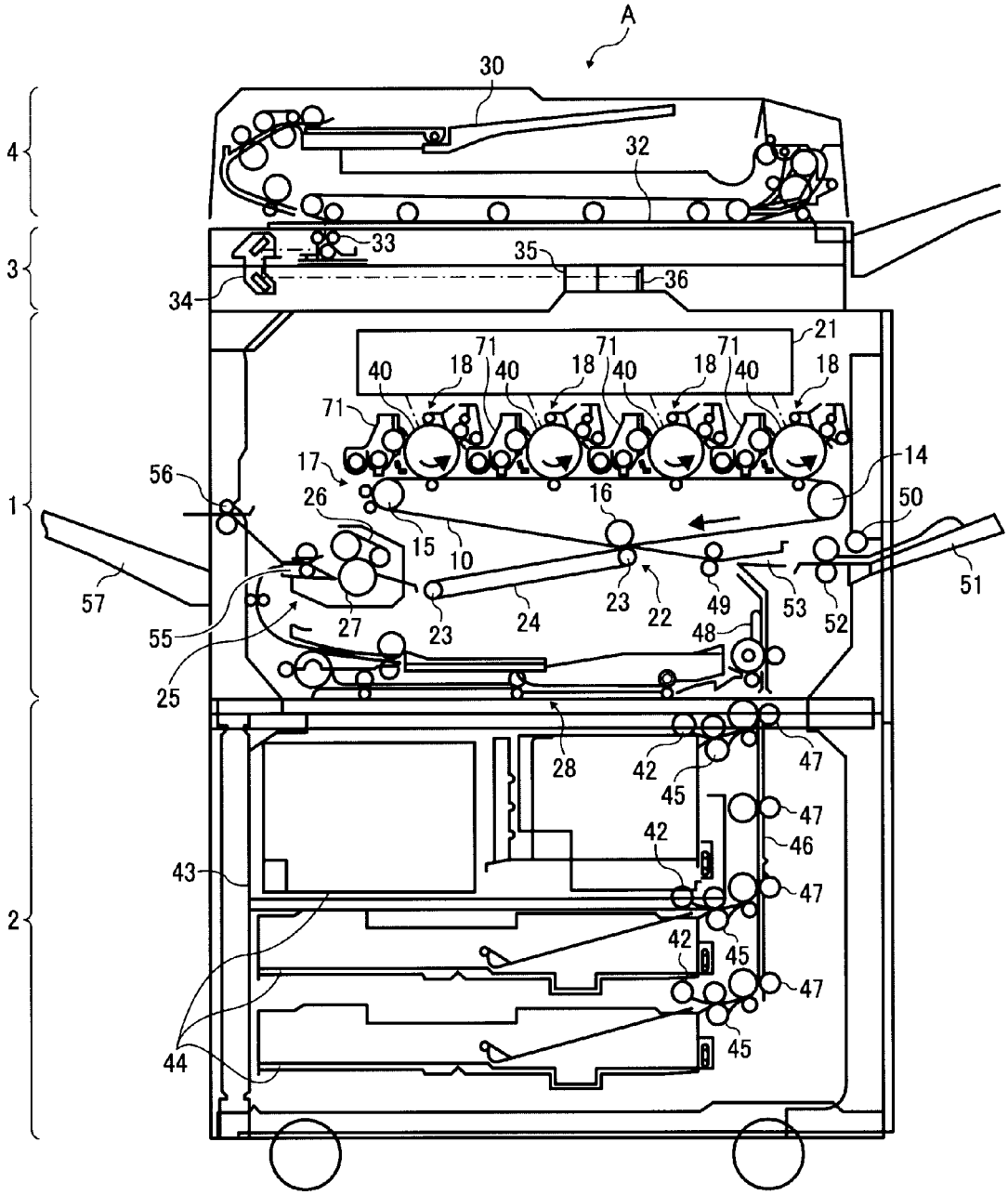
FIG. 1 schematically illustrates an image forming apparatus incorporating a developer supply system according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus A incorporating a developer supply system B according to this patent specification.

As shown in FIG. 1, the image forming apparatus A is an electrophotographic tandem color printer 1 having a sheet feeder 2 located at the bottom, and an image scanner 3 and an automatic document feeder (ADF) 4 located at the top.

In the image forming apparatus A, the printer 1 includes a series of process cartridges or replaceable imaging stations 18 for four primary colors, black, cyan, magenta, and yellow, each including a photoconductive drum 40 and a development device 71 featuring the developer supply system B, not visible from the angle at which FIG. is drawn.

The printer 1 also includes an exposure unit 21 above the imaging stations 18, and an intermediate transfer belt 10 beneath the imaging stations 18, as well as a secondary transfer unit 22, a fixing unit 25, and a sheet handling mechanism composed of various rollers and guide members located below the intermediate transfer belt 10.

In the printer 1, the intermediate transfer belt 10 is trained around end support rollers 14 and 15 and a middle support roller 16 for rotation clockwise in the drawing, with a belt cleaner 17 located adjacent to the left support roller 15 for cleaning an outer surface of the belt 10 downstream of the middle support roller 16.

Immediately below the intermediate transfer belt 10, the secondary transfer unit 22 includes a secondary transfer belt 24 looped around a pair of support rollers 23, the upstream one of which is held against the roller 16 to form a secondary transfer nip. Alternatively, the secondary transfer unit 22 may use a non-contact transfer process based on a charging device instead of the belt 24, which requires an additional mechanism for forwarding a recording sheet throughout the transfer process.

Located at one side of the secondary transfer unit 22 is the fixing unit 25 formed of an endless fixing belt 26 and a pressure roller 27 held against the fixing belt 26. At the opposite side of the secondary transfer unit 22 is the sheet handling mechanism, including a pair of registration rollers 49, a sheet feed path 48 extending from the sheet feeder 2 to the registration rollers 49, a manual sheet feed path 53 extending to the registration rollers 49 from a manual feed tray 51, a sheet feed roller 50, and a pickup roller 52. Also included are a sheet diverter 55, an output roller 56, and an output tray 57, all located downstream of the fixing unit 25, as well as a sheet reversing unit 28 extending laterally below the secondary transfer unit 22 and the fixing unit 25.

Additionally, the ADF 4 includes an input tray 30 integral with a document cover, and the scanner 3 includes a platen glass 32, a movable light source 33, a movable reflecting mirror 34, an imaging lens 35, and a read sensor 36. The sheet feeder 2 includes tiers of trays 44 for holding recording sheets, each having a sheet feed roller 42 and a pickup roller 45 associated therewith, and connecting to the printer sheet feed path 48 through a sheet feed path 46 defined by a series of guide rollers 47.

To print a copy with the image forming apparatus A, a user places an original document on the tray 30 and subsequently presses a start button, not shown, so that the ADF 4 automatically feeds the document onto the platen glass 32 to start scanning process. Alternatively, the user may manually initiate scanning by opening the ADF cover, placing an original document on the platen glass 32, closing the cover, and pressing the start button.

Upon initiation, the scanner 3 drives the light source 33 and the reflecting mirror 34 to scan the original document across the platen glass 32. More specifically, the light source 33 emits light toward the platen glass 32 and directs light reflected off the document surface to the mirror 34, which redirects the reflected light to the read sensor 36 through the imaging lens 35. Based on the incoming light signals, the sensor 36 generates image data for printing the scanned image.

Simultaneous with the scanning process, the printer 1 activates a motor, not shown, to rotate one of the support rollers 14 through 16, which in turn rotates in sync the intermediate transfer belt 10 and the rest of the support rollers. The printer 1 also directs each imaging station 18 to drive the photoconductor drum 40 and various imaging modules, thereby forming black, yellow, magenta, and cyan toner images on the respective photoconductor drums 40. As the intermediate transfer belt 10 travels along the imaging stations 18, the toner images are sequentially transferred to the belt surface from the photoconductors 40, thereby forming a composite, full-color image.

Meanwhile, in the sheet feeder 2, the feed roller 42 feeds recording sheets from the feed tray 44, and the pickup roller 45 draws a single sheet off the sheet stack and forwards it to the sheet feed path 46. Each fed sheet travels upward along the series of feed rollers 47 to enter the printer 1 through the sheet feed path 48. Instead of such automatic sheet feeding, the printer 1 may derive a recording sheet from the manual feed tray 51, in which case the manual feed roller 50 rotates to pick up a single recording sheet with the pickup roller 53 and advances it to the sheet feed path 53. In either case, the recording sheet fed along the feed path stops before the secondary transfer nip with the leading edge held between the registration rollers 49 remaining at rest.

The registration rollers 49 starts rotation to forward the recording sheet in response to the toner image reaching the secondary transfer nip, so that the toner image transfers from the belt surface to the sheet surface. After secondary transfer, the intermediate transfer belt 10 is cleaned of residual toner with the belt cleaner 17 in preparation for another printing cycle, and the recording sheet is forwarded to the fixing unit 25.

In the fixing unit 25, the fixing belt 25 and the roller 26 fix the powder toner image in place with heat and pressure to form a permanent image on the recording sheet, thereby completing the printing cycle. The recording sheet after fixing proceeds to the sheet diverter 55 which may direct the incoming sheet to the output roller 56 and the output tray 57 for user pickup, or to the sheet reversing unit 28 for duplex printing. In the case of duplex printing, the sheet reversing unit 28 turns the recording sheet upside down and refeeds it the feed path 48 for further printing on the reverse side.

In the image forming apparatus A, the developer supply system B according to this patent specification supplies new toner to the imaging station 18 as the development device 71 becomes depleted of toner during image formation.

Figure 2:
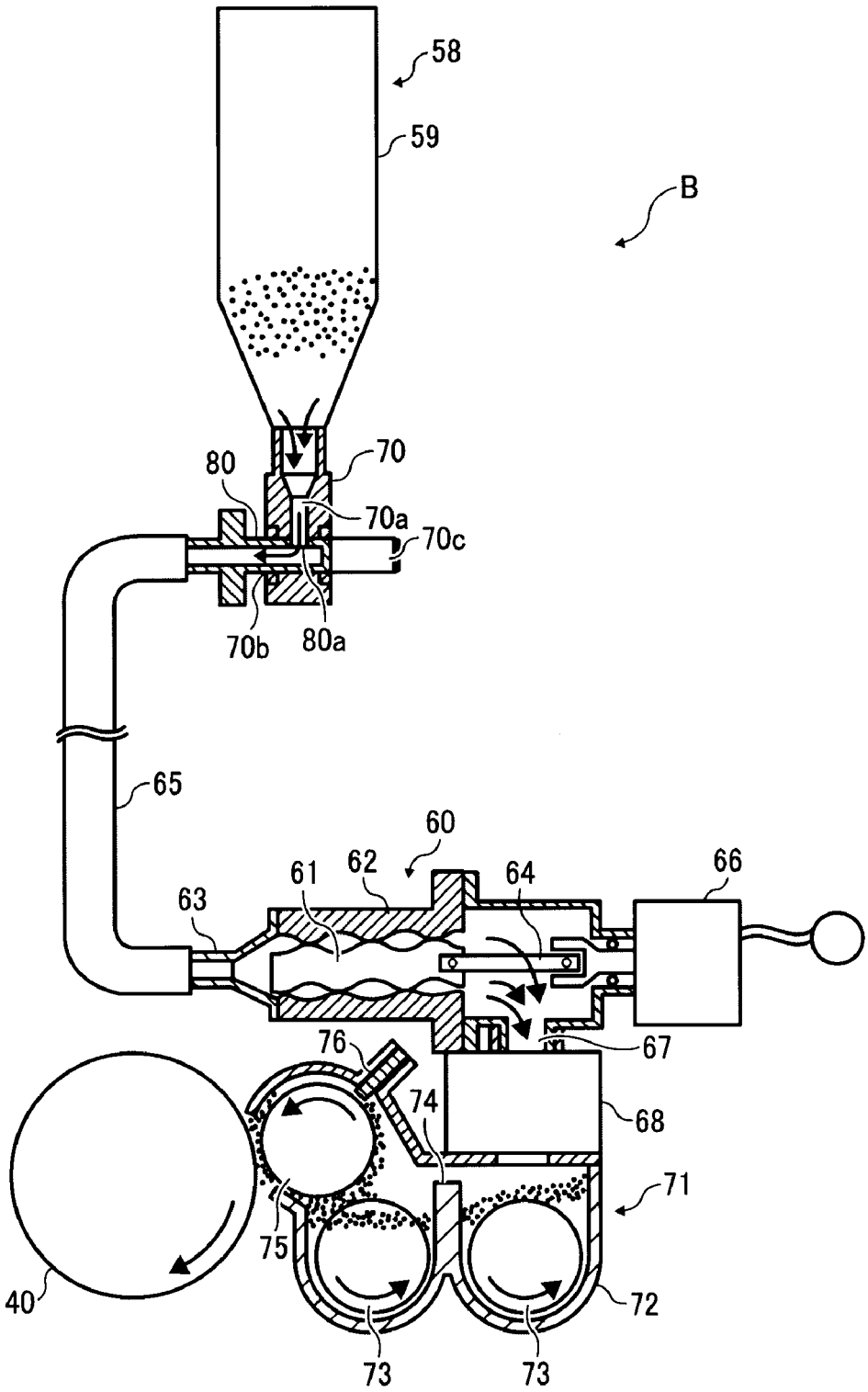
FIG. 2 is a cross-sectional view schematically illustrating the developer supply system combined with a development device in the image forming apparatus of FIG. 1.

FIG. 2 is a cross-sectional view schematically illustrating the developer supply system B combined with the development device 71 in the image forming apparatus A.

As shown in FIG. 2, the development device 71 includes a sump 72 to hold a two-component developer formed of a mixture of toner and carrier particles, a pair of augers or helical screw conveyors 73 rotating counterclockwise in the drawing, and a partition 74 between the conveyors 73 to divide the sump 72 into two separate chambers connected to each other at both ends of the sump 72. In the development device 71, rotation of the conveyors 73 conveys developer particles in directions perpendicular to the sheet of paper on which the FIG. is drawn (i.e., toward and away from the viewer), so that the developer passes from one chamber to another to circulate around the developer sump 72.

Above the developer sump 72, the development device 71 also includes a developer applicator or roller 75 rotating in the proximity of the photoconductor drum 40, and a doctor blade 76 held against the developer roller 75. The developer roller 75 magnetically attracts a part of the developer circulating within the sump 72, and the doctor blade 76 regulates the amount of particles carried on the roller surface to form an even layer of developer. The developer layer is then brought into contact with an electrostatic latent image formed on the photoconductor drum 40, resulting in toner transferred to the electrostatic image from the developer layer to develop it into a visible toner image.

Thus, the developer accommodated in the developer sump 72 loses a certain amount of toner as the development process proceeds. Accordingly, the developer supply system B supplies toner in small amounts so as to maintain a constant concentration of toner in the developer.

With further reference to FIG. 2, the developer supply system B includes a replaceable developer container 58 formed of a deformable bag 59 and a fitting 70, as well as a transport path defined by a connector nozzle 80, a flexible tube 65, and a progressive cavity pump 60.

Specifically, in the developer supply system B, the bag 59 accommodates toner or developer material for supply to the development device 71. The fitting 70 has a single exit port 70*a* to discharge toner from the toner bag 59, an insert opening 70*b* to insert the connector nozzle 80, and a plug 70*c* to fit inside the opening 70*b* to close the exit port 70*a* before installation. The connector nozzle 80 has one end communicating with the exit port 70*a* through an inlet opening 80*a*, and another end leading to the flexible tube 65 extending downward to communicate with the progressive cavity pump 60. The pump 60 impels toner from the developer container 58 to the development device 68 along the transport path with suction or negative pressure.

More specifically, the pump 60 mainly consists of a rotor 61 driven by a motor 66 via a universal joint 64, a stator 62 surrounding the rotor 61, an inlet port 63 open to the lower end of the tube 65, and an outlet port 67 leading to a hopper 68. The rotor 61 is a rigid helical shaft circular in cross-section, and the stator 62 defines a rubber-lined helical hole oval in cross-section with a pitch twice that of the helical shaft. The rotor 61 and the stator 62 engage each other to form a series of cavities therebetween, which progress from left to right in the drawing as the rotor 61 rotates inside the stator 61. The rotation of the rotor 61 sucks toner particles from the inlet opening 63 into the progressing cavities, delivering them along the stator 62, and pumps them out into the hopper 68 through the outlet port 67. The toner entering the hopper 68 travels downward to be discharged into the development device 68.

Figure 3:
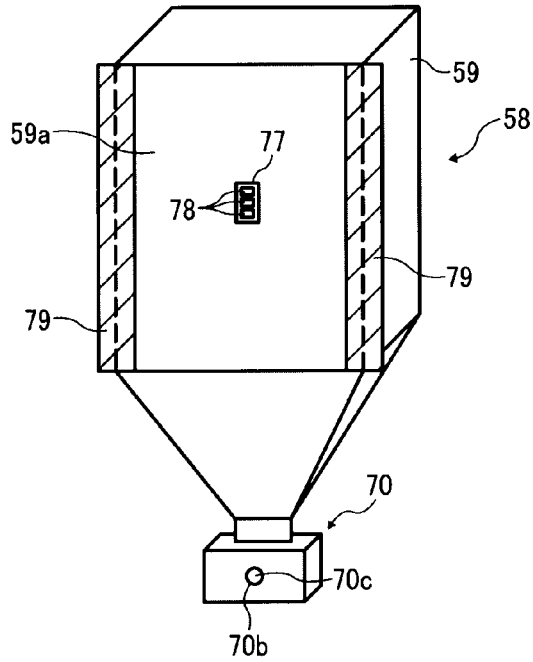
FIG. 3 is a perspective view schematically illustrating a developer container for use in the developer supply system of FIG. 2 according to one embodiment of this patent specification.

FIG. 3 is a perspective view schematically illustrating the developer container 58 for use in the developer supply system B according to one embodiment of this patent specification.

As shown in FIG. 3, the developer container 58 has the deformable bag 59 with one end connected to the fitting 70. The bag 59 is formed by welding parts of a plastic laminate ranging from 50 to 300 μm in thickness, and may include resin and other suitable materials depending on the physical properties and intended use of the contents (i.e., whether they are solid, liquid, particulate, etc., and whether they are for food purposes or medical purposes, etc.)

Such materials may include polyethylene or plastics with a relatively low melting point for an interior layer, and polyethylene terephthalate (PE), nylon, aluminum, paper, etc., for exterior and intermediate layers. In the present embodiment, the bag 59 is composed of an exterior layer of PET, an intermediate layer of nylon, and an interior layer of polyethylene.

The bag 59 thus formed of a thin plastic film is collapsible, i.e., the bag changes its shape as its contents change in volume or in shape, and when empty, may fold up into a compact form, allowing for easy recycling or disposal.

Additionally, the fitting 70 shown with the plug 70*c* inserted in the opening 70*b* is formed of molded plastic. The fitting 70 may have any suitable configuration, and further description is omitted in the interest of brevity.

According to this patent specification, the developer container 58 has a data carrier or memory tag 77 located remote from the opening 70*b* and attached to a planar surface 59*a* of the toner bag 59. The memory tag 77 is a thin rectangular integrated circuit (IC) chip having terminals 78 on a front side (i.e., the side facing away from the base surface 59*a*), and electrical equipment on a rear side opposite to the front side. The memory tag 77 stores information about the developer container 58 and the toner contained therein, such as type of compatible printer, color of toner, date of manufacture, remaining amount of toner, etc. Such identification data is readable and writable by the image forming apparatus A, not shown, when the terminals 78 are adjacent to or in contact with a contact area 91*b*, not shown, provided on the image forming apparatus A.

The developer container 58 also includes a pair of reinforcing strips 79 made of material stiffer than that of the plastic bag 59, attached to opposed sides of the planar surface 59*a* for reinforcement purposes. The reinforcing strips 79 each has a portion lying off the edge of the surface 59*a*, which forms part of a positioning mechanism C to position the developer container 58 in the image forming apparatus A as will be described later in more detail.

Figure 4:
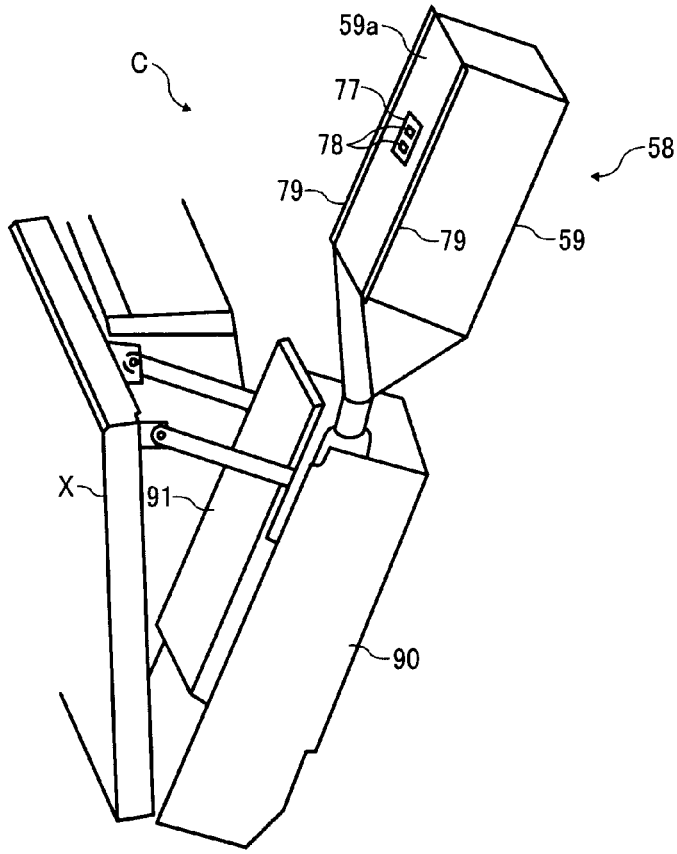
FIG. 4 is a perspective view schematically illustrating a positioning mechanism of the developer supply system incorporated in the image forming apparatus of FIG. 1.

FIG. 4 is a perspective view schematically illustrating the positioning mechanism C of the developer supply system B incorporated in the image forming apparatus A.

As shown in FIG. 4, in addition to the pair of reinforcing strips 79 provided on the developer container 58, the positioning mechanism C includes a holder 90 with a guide plate 91 to hold the developer container 58 in the image forming apparatus A. In the positioning mechanism C, the holder 90 is hinged on a frame X of the image forming apparatus A, and the guide plate 91 forms one side of the holder 90 with a front surface facing the apparatus frame X and a back surface facing the interior of the holder 90. The holder 90 is properly sized to enclose the developer container 58 therein, with an upper side open to insert the container 58 therethrough, and a lower side allowing insertion of the nozzle 80 into the opening 70*b* during installation of the container 58.

Figure 5A:
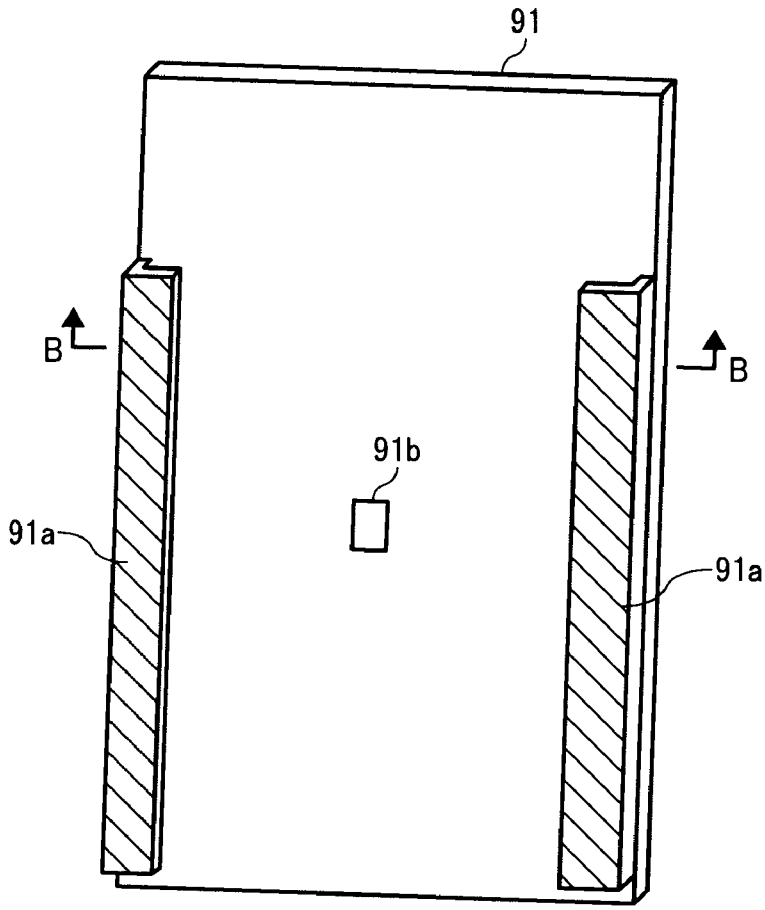
FIGS. 5A and 5B schematically illustrate a guide plate used in the positioning mechanism of FIG. 4.
Figure 5B:
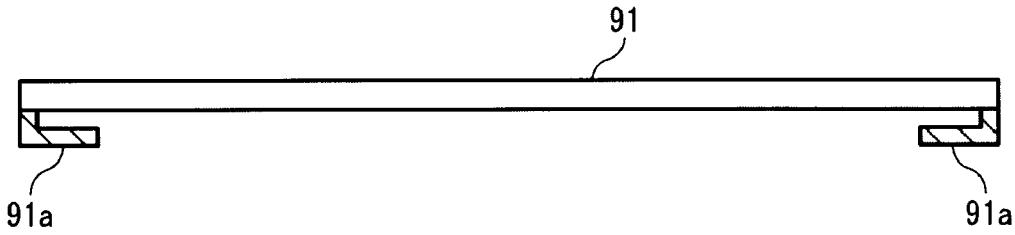

FIG. 5A is a perspective view schematically illustrating the back surface of the guide plate 91, and FIG. 5B is a cross-sectional view taken along line B-B of FIG. 5A.

As shown in FIGS. 5A and 5B, the guide plate 91 has a pair of parallel guide rails 91*a* and the contact area 91*b* on the back surface. The guide rails 91*a*, each forming an elongated slot for slidably receiving the reinforcing strip 79 during installation of the developer container 58, extend along opposite sides of the back surface. The contact area 91*b* is located between the guide rails 91*a* so as to contact the terminals 78 of the memory 78 when the developer container 58 is properly installed.

Referring back to FIG. 4, to install the developer container 58, the hinged holder 90 is inclined several tens of degrees with respect to the frame X from an upright position. The container 58 is then inserted into the holder 90 from above with the surface 59*a* facing the guide plate 91 and the side strips 79 sliding along the guide rails 91*a*. When fully seated, the developer container 58 has the surface 59*a* in contact with the back surface of the guide plate 91 so that the terminals 78 of the memory tag 77 and the contact area 91*b* of the image forming apparatus A establish an electrical connection therebetween. After insertion, the holder 90 is turned back to its original upright position to complete installation of the developer container 58.

Thus, the positioning mechanism C according to this patent specification holds the developer container 58 therein while maintaining the planar surface 59*a* in position relative to the image forming apparatus A. Preferably, the guide strips 79 are provided only on the single surface 59*a* and not on opposed surfaces of the bag 59. This prevents an untrained user from inserting the container 58 in the holder 90 in the wrong orientation, which would result in failure to properly position the memory tag 77 adjacent to the contact area 91*b*.

Further, such installation of the developer container 58 coincides with establishment of fluid communication between the container 58 and the image forming apparatus A, in which the fitting 70 of the developer container 58 engages the connector nozzle 80 of the transport path upon rotation of the holder 90 into the upright position.

Figure 6A:
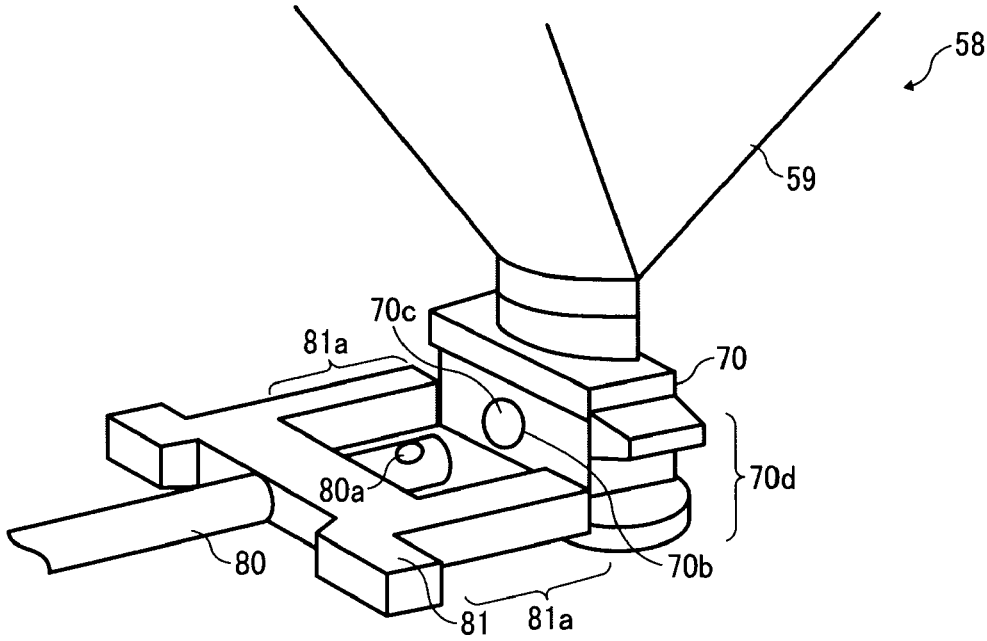
FIGS. 6A and 6B are partial perspective views schematically illustrating automatic engagement of a fitting and a connector nozzle in the developer supply system of FIG. 2.
Figure 6B:
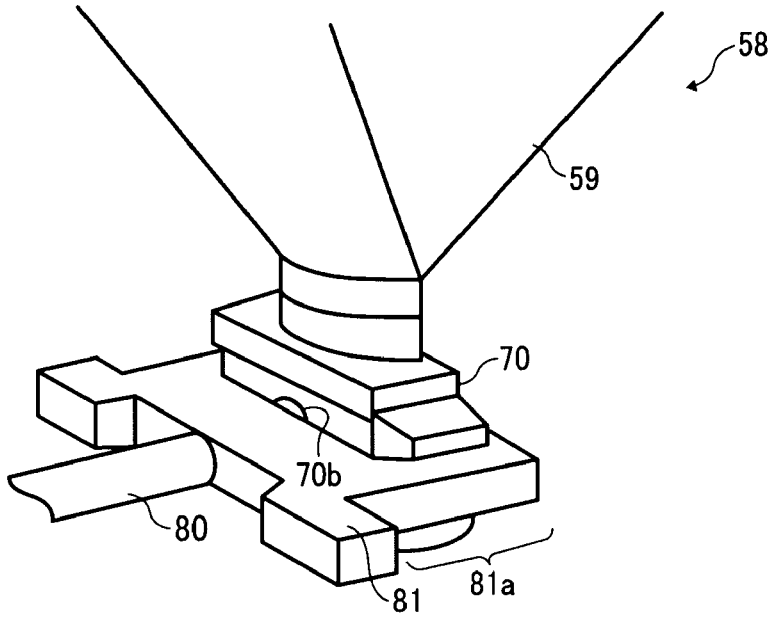

FIGS. 6A and 6B are partial perspective views schematically illustrating engagement of the fitting 70 and the connector nozzle 80.

As shown in FIGS. 6A and 6B, the fitting 70 has a pair of mounts 70*d* on opposite sides thereof in addition to the exit port 70*a*, the insert opening 70*b*, and the plug 70*c* described earlier. On the other hand, the connector nozzle 80 is fixed on the image forming apparatus A with a nozzle support 81 having a pair of guide arms 81*a* on opposite sides thereof.

When the container 58 is inserted into the inclined holder 90, the fitting 70 is located in front of the nozzle 80 supported on the nozzle support 81 with the inlet opening 80*a* facing upward (FIG. 6A). In this state, turning the holder 90 to the upright position causes the guide arms 81*a* to interlock with the mounts 70*d*, and the nozzle 80 to enter the opening 70*b* by forcing out the plug 70*c* therefrom (FIG. 6B). With the fitting 70 and the nozzle 80 thus engaged together, the nozzle inlet opening 80*a* is aligned with the exit port 70*a* inside the fitting 70, thereby establishing fluid communication between the container 58 and the transport path of the developer supply system B.

With electrical contact and the fluid communication thus properly established upon installation, the developer supply system B is now ready to supply new toner to the development device 71 in the image forming apparatus A. To remove the developer container 58 exhausted after use, a user may incline the holder 90 from the upright position. This removes the nozzle 80 from the opening 70*b* and restores the plug 70*c* into position, which allows subsequent withdrawal of the container 58 from the holder 90.

Figure 7:
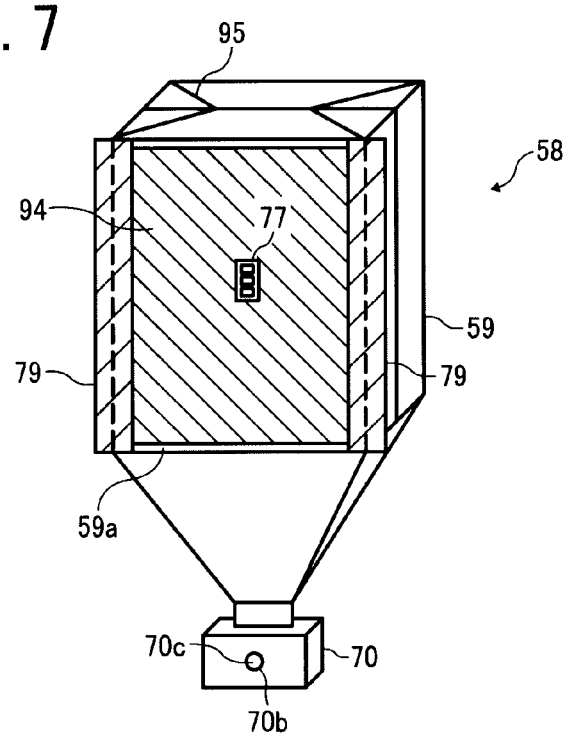
FIG. 7 is a perspective view illustrating the developer container for use in the developer supply system of FIG. 2 according to another embodiment of this patent specification.

FIG. 7 is a perspective view illustrating the developer container 58 for use in the developer supply system B according to another embodiment of this patent specification.

As shown in FIG. 7, this embodiment is similar to that depicted in FIG. 3, except that the developer container 58 has a stiffening sheet 94 attached to the planar surface 59*a* in addition to the side strips 79, and fold lines 95 preformed across side surfaces of the bag 59. The stiffening sheet 94 covers the entire planar surface 59*a* except where the memory tag 77 is provided, making the surface 59*a* stiffer than other surfaces of the bag 59. The preformed lines 95 allow the bag 59 to collapse inwardly therealong as its contents are consumed.

In such a configuration, the toner bag 59, when held in the holder 90, tends to collapse only toward the planar surface 59*a*, which reliably maintains the surface 59 in continuous and consistent contact with the guide plate 91. Further, preforming the fold lines 95 allows smooth discharge of developer from the bag 59, since it prevents the bag 59 from forming additional folds or creases in the side or back surfaces where toner particles would lodge and remain undischarged. Although both structures work well if used individually, the combined use of the stiffening sheet 94 and the fold lines 95 effectively allows the positioning mechanism C to maintain the planar surface 59*a* in position relative to the image forming apparatus A.

Preferably, the developer container 58 has an additional stiffening sheet attached to a surface opposite to the planar surface 59*a* of the bag 59. The pair of stiffening sheets more effectively causes the bag 59 to collapse in a single direction than the single stiffening sheet reinforcing only the front surface. In addition, the bag 59 with the opposed surfaces reinforced is easy to fold compact when emptied, allowing for convenient disposal by a user replacing the developer container.

Figure 8A:
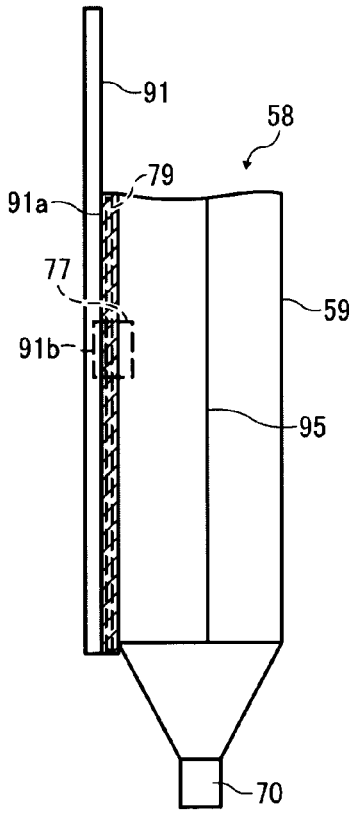
FIGS. 8A and 8B are partial side elevational views illustrating the developer container of FIG. 7 before and after removal of contents.
Figure 8B:
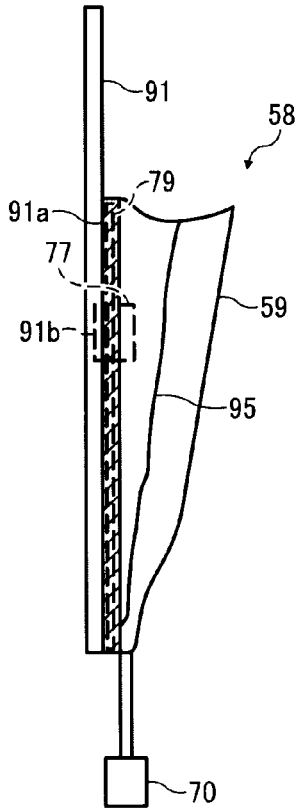

FIGS. 8A and 8B are partial side elevational views illustrating the developer container 58 before and after removal of contents from the toner bag 59.

As shown in FIGS. 8A and 8B, the side strips 79 and the guide rails 91*a* engaged together retain the planar surface 59*a* in contact with the guide plate 91 regardless of whether the bag 59 is full or empty. This results in the memory tag 77 being fixed in the vicinity of the contact area 91*b* to reliably maintain electrical contact between the developer container 58 and the image forming apparatus A. Unlike a configuration that provides a memory around an exit port of a developer container, the memory tag 77 located remote from the exit port 70*a* may be kept free from contamination even when the developer leaks from the exit port 70*a*.

Numerous additional modifications and variations are possible in light of the above teachings.

For example, the positioning mechanism C to position the developer container 58 may be other than that using the combination of side strips and guide rails, as long as it can retain the planar surface of the bag in position relative to the image forming apparatus A even when the bag contracts as it discharges its contents.

Further, although the embodiment described above uses the stiffening sheet(s) attached to the front surface or to the front and rear surfaces of the toner bag, alternatively, the positioning mechanism according to this specification may include one or more stiffening sheets attached to surfaces of the bag other than the front and/or rear surface(s).

It is therefore to be understood that, within the scope of the appended claims, the disclosure of this patent specification may be practiced otherwise than as specifically described herein.

What is claimed is:

1. A developer supply system that supplies developer in an image forming apparatus, the system comprising:

a container including a deformable bag formed of flexible material that accommodates developer therein;

a data carrier attached to a planar surface of the deformable bag, the data carrier storing information for communication with the image forming apparatus; and a positioning mechanism that holds the container therein while maintaining the planar surface in position relative to the image forming apparatus when the deformable bag collapses as it discharges developer.

2. The developer supply system according to claim 1, wherein the deformable bag has a preformed fold line to collapse inwardly therealong upon discharge of developer.

3. The developer supply system according to claim 1, wherein the positioning mechanism includes:

a holder provided on the image forming apparatus to install the container therein; and a pair of reinforcing strips extending along opposed sides of the planar surface parallel to a direction in which the container is inserted into the holder during installation.

4. The developer supply system according to claim 3, wherein reinforcing strips are only disposed on the planar surface of the deformable bag.

5. The developer supply system according to claim 3, wherein each of the reinforcing strips includes at least a portion of a longitudinal edge that projects beyond an outer edge of the planar surface.

6. The developer supply system according to claim 5, wherein the positioning mechanism includes a guide plate having a pair of guide rails attached thereto, the guide rails being positioned on the guide plate so as to receive and secure the portion of the longitudinal edges of the reinforcing strips, respectively, upon insertion of the container into the guide plate.

7. The developer supply system according to claim 6, wherein the reinforcing strips are slidably accommodated in the guide plate.

8. The developer supply system according to claim 1, wherein the positioning mechanism includes a stiffening sheet attached at least to the planar surface.

9. The developer supply system according to claim 1, wherein the positioning mechanism includes a stiffening sheet attached only to the planar surface.

10. The developer supply system according to claim 1, wherein the positioning mechanism includes a pair of stiffening sheets attached to the planar surface and a surface opposite to the planar surface.

11. The developer supply system according to claim 1, wherein the data carrier is disposed remote from a fitting through which developer is discharged.

12. The developer supply system according to claim 1, wherein the container further includes first and second reinforcing strips extending, respectively, along opposite sides of the planar surface, parallel to a direction in which the container is accommodated in the positioning mechanism, and wherein the data carrier is disposed between the first and second reinforcing strips, and remote from a fitting through which developer is discharged.

13. The developer supply system according to claim 1, wherein the container further includes first and second reinforcing strips extending, respectively, along opposite sides of the planar surface, parallel to a direction in which the container is accommodated in the positioning mechanism, and a stiffening sheet attached at least to the planar surface.

14. An image forming apparatus comprising:

a developer supply system that supplies developer, the system including:

a container including a deformable bag formed of flexible material that accommodates developer therein;

a data carrier attached to a planar surface of the deformable bag, the data carrier storing information for communication with the image forming apparatus; and a positioning mechanism that holds the container therein while maintaining the planar surface in position relative to the image forming apparatus when the deformable bag collapses as it discharges developer.

15. The image forming apparatus according to claim 14, wherein the deformable bag has a preformed fold line to collapse inwardly therealong upon discharge of developer.

16. The image forming apparatus according to claim 14, wherein the positioning mechanism includes:

a holder provided on the image forming apparatus to install the container therein; and a pair of reinforcing strips extending along opposed sides of the planar surface parallel to a direction in which the container is inserted into the holder during installation.

17. The image forming apparatus according to claim 14, wherein the positioning mechanism includes a stiffening sheet attached at least to the planar surface.

18. The image forming apparatus according to claim 14, wherein the positioning mechanism includes a stiffening sheet attached only to the planar surface.

19. The image forming apparatus according to claim 14, wherein the positioning mechanism includes a pair of stiffening sheets attached to the planar surface and a surface opposite to the planar surface.

20. A process cartridge for use in an image forming apparatus, the cartridge comprising:

a developer supply system to supply developer, the system including:

a container including a deformable bag formed of flexible material that accommodates developer therein;

a data carrier attached to a planar surface of the deformable bag, the data carrier storing information for communication with the image forming apparatus; and a positioning mechanism that holds the container therein while maintaining the planar surface in position relative to the image forming apparatus when the deformable bag collapses as it discharges developer.

* * * * *